US006986538B1

(12) United States Patent
Ecker

(10) Patent No.: US 6,986,538 B1
(45) Date of Patent: Jan. 17, 2006

(54) DEVICE FOR STORING AND CARRYING HOLE SAWS

(76) Inventor: Robert J. Ecker, 128 Carriage Rd., Chicopee, MA (US) 01013

( * ) Notice: Subject to any disclaimer, the term of this patent is extended or adjusted under 35 U.S.C. 154(b) by 2 days.

(21) Appl. No.: 10/314,397

(22) Filed: Dec. 6, 2002

Related U.S. Application Data

(60) Provisional application No. 60/345,345, filed on Jan. 4, 2002.

(51) Int. Cl.
*B25G 3/38* (2006.01)
*B65D 71/00* (2006.01)

(52) U.S. Cl. ..... 294/158; 294/137; 206/349; 206/493

(58) Field of Classification Search ..... 294/137, 294/142, 143, 158, 169; 408/204, 224, 118; 206/303, 349, 379, 493
See application file for complete search history.

(56) References Cited

U.S. PATENT DOCUMENTS

| | | | | |
|---|---|---|---|---|
| 2,598,643 | A * | 5/1952 | Kaplan et al. | 294/143 |
| 2,842,329 | A * | 7/1958 | Friedman et al. | 248/340 |
| 2,892,269 | A * | 6/1959 | Pospiszel | 294/142 |
| 3,224,655 | A * | 12/1965 | Buchanan et al. | 294/158 |
| 3,289,985 | A * | 12/1966 | Sheiman | 248/95 |
| 3,633,801 | A * | 1/1972 | Bonasso | 294/142 |
| 3,804,310 | A * | 4/1974 | Wheeler | 294/142 |
| 4,162,031 | A * | 7/1979 | Summersby | 294/158 |
| 4,415,080 | A * | 11/1983 | Romine et al. | 206/303 |
| 4,750,697 | A * | 6/1988 | Tontarelli | 24/372 |
| 4,784,263 | A * | 11/1988 | Stanley | 206/349 |
| 4,789,303 | A * | 12/1988 | Frazzell et al. | 416/63 |
| 4,958,873 | A * | 9/1990 | Akagawa | 294/93 |
| 5,074,445 | A * | 12/1991 | Chen | 223/85 |
| 5,445,425 | A * | 8/1995 | Lyver | 294/31.2 |
| 5,803,677 | A | 9/1998 | Brutscher et al. | |

FOREIGN PATENT DOCUMENTS

| | | | |
|---|---|---|---|
| JP | 58010415 | * | 1/1983 |

* cited by examiner

*Primary Examiner*—Dean J. Kramer
*Assistant Examiner*—Paul T. Chin
(74) *Attorney, Agent, or Firm*—Holland & Bonzagni, P.C.; Donald S. Holland, Esq.

(57) ABSTRACT

A device for storing and carrying hole saws comprises a stack pin and a retaining handle removably attachable to the stack pin. The stack pin has a widened "bun" or head at one end and a lateral keyhole slot near its other end. One end of the handle has a key-like element, by which the handle can only be detached from the stack pin when the key is properly aligned with the stack pin's keyhole slot. For use, the handle is detached from the stack pin by first orienting the handle to align the key with the keyhole slot and by then sliding the handle through the keyhole slot. Subsequently, hole saws are nested and stacked onto the stack pin, and the handle is re-attached to the stack pin, preventing the hole saws from being removed from the stack pin.

11 Claims, 4 Drawing Sheets

DEVICE FOR STORING AND CARRYING HOLE SAWS

This application claims the benefit of U.S. Provisional Application Ser. No. 60/345,345, filed Jan. 4, 2002.

FIELD OF THE INVENTION

The present invention relates to tools, and, more particularly, to devices for storing and carrying tools.

BACKGROUND OF THE INVENTION

Hole saws (also known as rotary cutters, shell cutters, crown drills, and hole cutters) are commonly used in both domestic and commercial settings to cut small- to medium-sized round holes in walls or other objects. U.S. Pat. No. 5,803,677, with reference to its FIG. 1, shows a conventional, representative hole saw 10.

Because each hole saw 10 can only be used to cut one size of hole, people that commonly need to cut round holes, such as carpenters, electricians, and plumbers, typically have a number of hole saws in various sizes and configurations. Unfortunately, all these hole saws can be difficult to organize and carry—oftentimes, they will simply end up jumbled together at the bottom of a toolbox or even flying around loose in a work vehicle. This problem is exacerbated for those who frequently move from one worksite to another.

Additionally, the most popular current method of storing and carrying hole saws is a variety of different sized "kits" or boxes that are bulky and inconvenient (i.e., where each hole saw has its own circular storage slot).

Accordingly, a primary object of the present invention is to provide a device for organizing, storing, and carrying a plurality of hole saws.

SUMMARY OF THE INVENTION

A device for storing and carrying hole saws, referred to under the trademark Hole Caddy™, comprises a bolt-like stack pin and a carrying/retaining handle that is removably attachable to the stack pin. The stack pin is generally cylindrical, and has a widened "bun" or head at one end and a lateral keyhole slot near its other end. One end of the handle has a key-like element, by which the handle can only be detached from the stack pin when the key is properly aligned with the stack pin's keyhole slot. For use, the handle is detached from the stack pin by first orienting the handle to align the key with the keyhole slot and by then sliding the handle through the keyhole slot. Subsequently, loose hole saws are nested together and stacked onto the stack pin, and the handle is re-attached to the stack pin, preventing the hole saws from being removed from the stack pin until the handle is once again detached. The stacked, nested hole saws can be hung or carried by way of the handle.

BRIEF DESCRIPTION OF THE DRAWINGS

These and other features, aspects, and advantages of the present invention will become better understood with respect to the following description, appended claims, and accompanying drawings, in which:

DETAILED DESCRIPTION OF THE INVENTION

Figure 3:
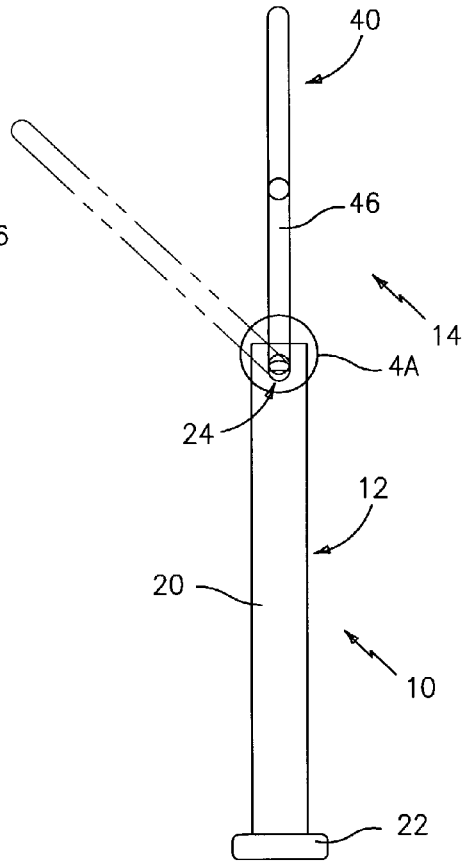
FIG. 3 is a side elevation view of the Hole Caddy.
Figure 2:
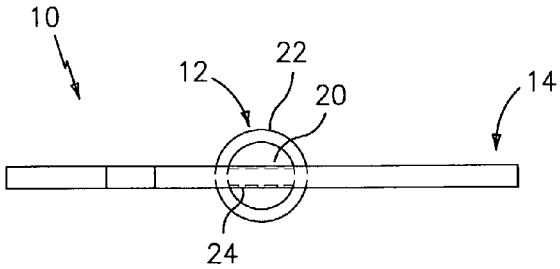
FIG. 2 is a top plan view of the Hole Caddy.
Figure 4A:
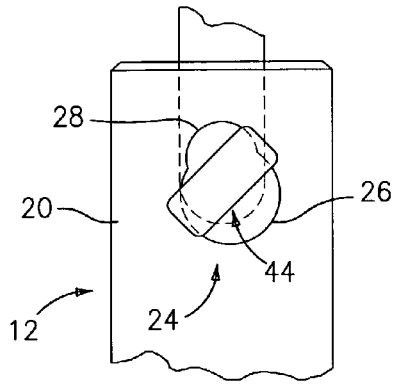
FIG. 4A is a detail view of a portion of FIG. 3.
Figure 4B:
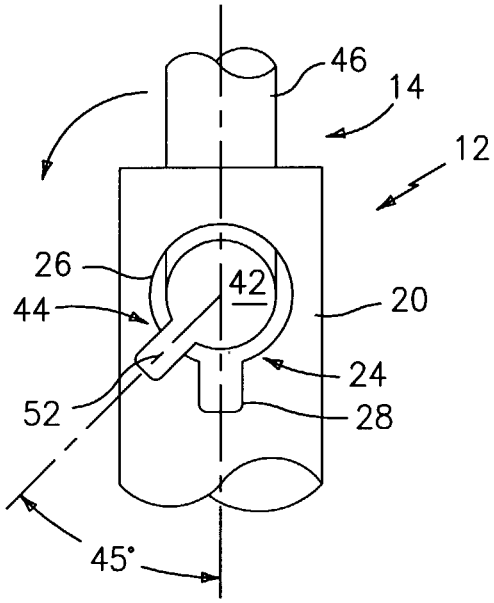
FIGS. 4B & 4C are conceptual or alternative views illustrating operation of a handle and key portion of the Hole Caddy.
Figure 4C:
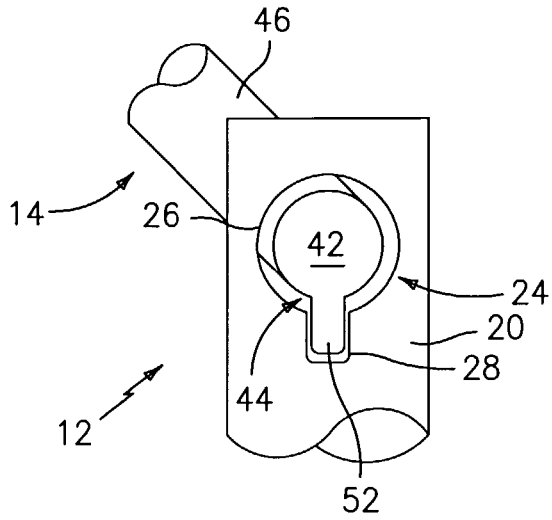
Figure 4D:
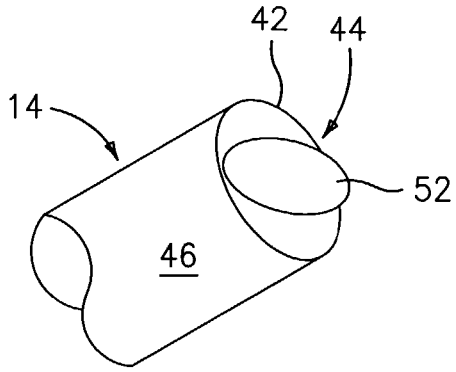
FIG. 4D is a perspective end view of a key portion of the Hole Caddy's handle.
Figure 5:
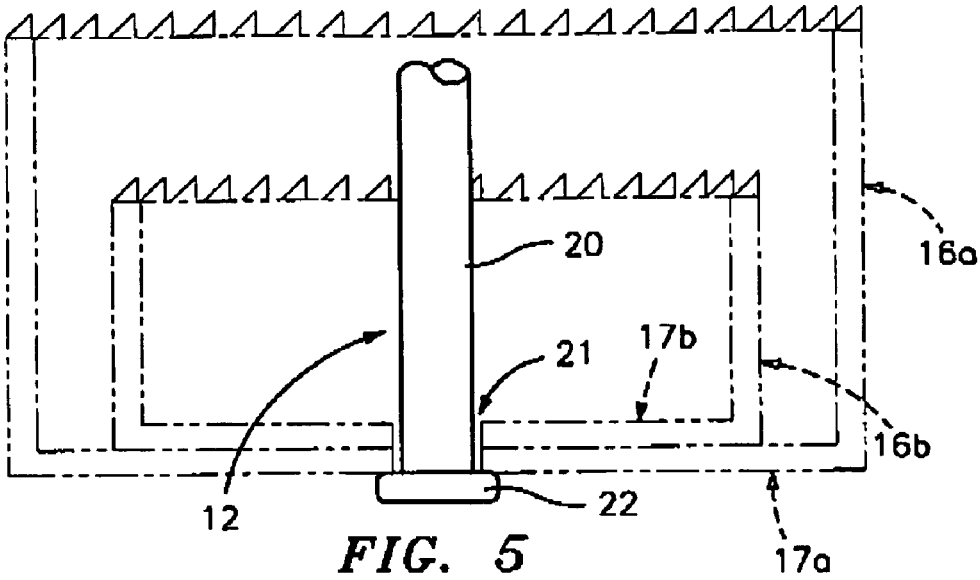
FIG. 5 is a front view, partially in section and partially in perspective, of the Hole Caddy in use.

Turning now to FIGS. 1–5, a preferred embodiment of a device or "carrying and storing" means 10 for carrying and storing differently sized hole saws, hereinafter referred to under the trademark Hole Caddy™, according to the present invention, will now be given. The Hole Caddy 10 comprises a bolt-like stack pin 12 and a carrying/retaining handle 14 that is removably attached to the stack pin 12. For use, the handle 14 is detached from the stack pin 12. Then, as shown in FIG. 5, differently sized hole saws 16*a*, 16*b* are nested together and stacked coaxially onto the stack pin 12, and (referring back to FIGS. 1–4D) the handle 14 is re-attached to the stack pin 12, preventing the hole saws 16 from being removed from the stack pin 12 until the handle 14 is once again detached. The nested hole saws can be hung or carried by way of the handle 14.

Turning now to the individual components in more detail, the stack pin 12 comprises: a generally cylindrical shaft 20; a radially-extended (widened) head or "bun" 22 at one end of the shaft (also referred to herein as a support means for supporting holes saws); and a transverse keyhole slot or throughbore 24 extending through the shaft proximate the shaft's other end. The keyhole slot 24, as its name implies, is generally keyhole-shaped, i.e., it includes a generally cylindrical main bore 26 extending laterally through the shaft 20, and a smaller-sized, secondary bore 28, offset from the main bore 26 but connected thereto, also extending laterally through the shaft 20. The secondary bore 28 may be aligned with the longitudinal axis of the shaft 20, i.e., to lie "above" or "below" the main bore 26 as shown in FIG. 4A (above) and FIGS. 4B and 4C (below), or it may have another orientation. The secondary bore 28 may be an actual semi-rectangular slot or trough, as shown in FIGS. 4B and 4C. However, for ease of manufacturing, it may also be provided as a second, smaller-diameter cylindrical bore offset from the main bore 26 (but connected and parallel thereto). For example, as shown in FIG. 4A, the main bore 26 is a 3/16" cylindrical through-bore, while the secondary bore 28 is formed as a 0.156" cylindrical through-bore offset from the main bore by 0.049".

As should be appreciated, the particular dimensions of the shaft 20 used in practice will depend on the size and type of hole saws meant to be carried by the Hole Caddy 10. More specifically, as shown in FIG. 5, the diameter of the shaft 20 should be no larger than the effective diameter of the connection openings (at 21) in the middle of the hole saw bases or back plates (e.g., 17*a*, 17*b*), while the bun 22 (support means) should be larger than the effective diameter of those central openings. One appropriate diameter for the shaft 20, suitable for many applications, is 9/16" (e.g., this will accommodate many standard hole saws), while one appropriate diameter for the bun 22 is 3/4".

As used herein, "nested" refers to smaller hole saws (e.g., 16*b*) being nestled or housed within the confines of the largest hole saw (e.g., 16*a*). The back plates (e.g., 17*a*, 17*b*) of the hole saws rest against each other when the Hole Caddy™ is in its upright orientation, illustrated in FIG. 5.

Figure 1:
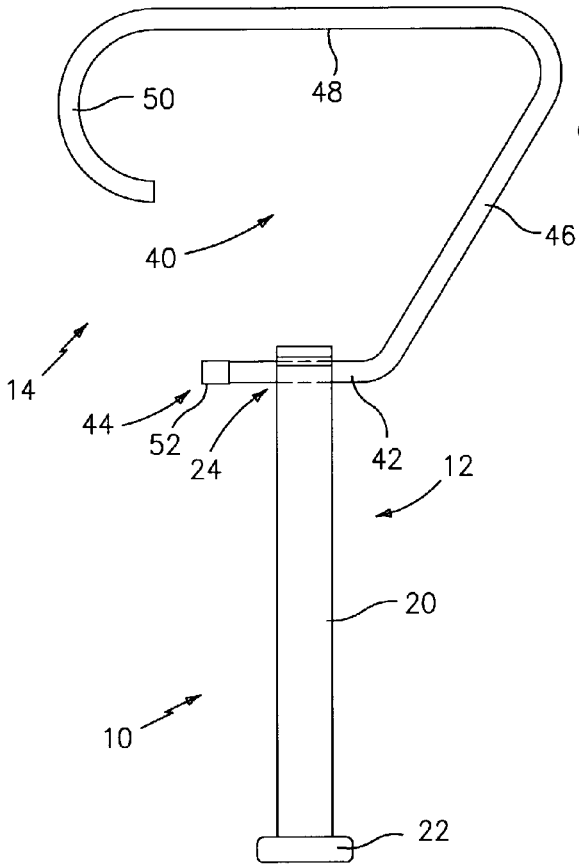
FIG. 1 is a front elevation view of a device for storing and carrying hole saws (Hole Caddy™) according to the present invention.

The handle 14 is best shown in FIG. 1. The handle 14 may be a plurality of individual components attached together, or it may be a unitary piece of appropriately-configured plastic or metal (e.g., one suitable material is 3/16" diameter, cold-rolled steel shaped via a bending jig or the like). Either way, the handle 14 comprises a carrying/hanging portion 40 and a straight, cylindrical retainer 42 that terminates at a "key" 44. The carrying/hanging portion 40 of the handle 14 includes: a riser 46 extending away from the end portion 42 at about a 60° angle with respect thereto; a handle portion 48, generally parallel to the end portion 42, extending back from the riser 46 at about a 60° angle with respect thereto; and a hanger 50, with a radius of about 5/8", curling around from the handle portion 48. The retainer 42, as mentioned, is straight and cylindrical, and has a diameter that is equal to or slightly less than the diameter of the main bore 26 of the keyhole slot 24, i.e., so that the retainer 42 fits through the main bore 26.

The key 44 comprises a tab-like protuberance 52 that extends beyond the diameter of the retainer 42. The protuberance 52 is angled at about a 45° with respect to a plane defined by the remainder of the handle 14, as shown in FIGS. 4A–4C (other angular orientations are possible as well). The key 44 may be formed by actually attaching a small, appropriately dimensioned and angled tab to the retainer 42. For ease of manufacture, however, the key 44 may also be formed by flattening the end of the retainer 42, as shown in FIGS. 1, 4A, and 4D, such that the end of the retainer extends past the diameter of the remainder of the retainer, on one or both sides.

The key 44 is dimensioned to pass through the keyhole slot 24 only when the handle 14 is appropriately positioned. In particular, the handle 14 can only be detached from the stack pin 12 when the tab-like protuberance portion 52 of the key 44 aligns with the secondary bore 28, which only happens when the handle 14 is pivoted to one particular angular orientation (i.e., out of 360°) with respect to the stack pin 12. The pivoting is transverse to a longitudinal axis of the shaft 20, and also transverse to the stack pin 12, as shown in FIG. 3. At all other pivoted-to positions, the protuberance 52 will strike the edge of the keyhole slot 24 instead of passing into and through the secondary bore 28 when the handle is pulled away from the stack pin. In addition to permitting the handle to be removed (when desired), the pivoting action of the handle 14 eases transport of the blades within the Hole Caddy™ 10.

For example, since the protuberance 52 is at, e.g., a 45° angle with respect to the rest of the handle, when the handle 14 is aligned with the stack pin 12 (i.e., the two are coplanar), as shown in FIGS. 1 and 4A, the protuberance 52 is misaligned with the secondary bore 28 of the keyhole slot 24. As such, the handle 14 cannot be detached from the stack pin 12, because the protuberance 52 hits the edge of the keyhole slot 24 when the handle 14 is moved away from the stack pin 12. However, when the handle 14 is rotated by 45°, as shown in FIG. 4C, the protuberance 52 aligns with the secondary bore 28, and the handle 14 can be detached from the stack pin 12 by pulling the retainer 42 and key 44 through the keyhole slot 24.

Figure 6:
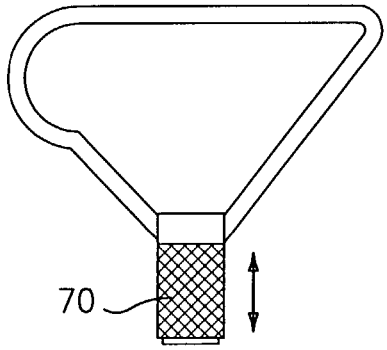
FIG. 6 is a front elevation view of a first alternative embodiment of the Hole Caddy.
Figure 6:
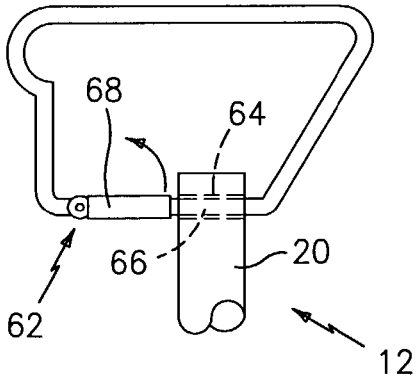
Figure 11:
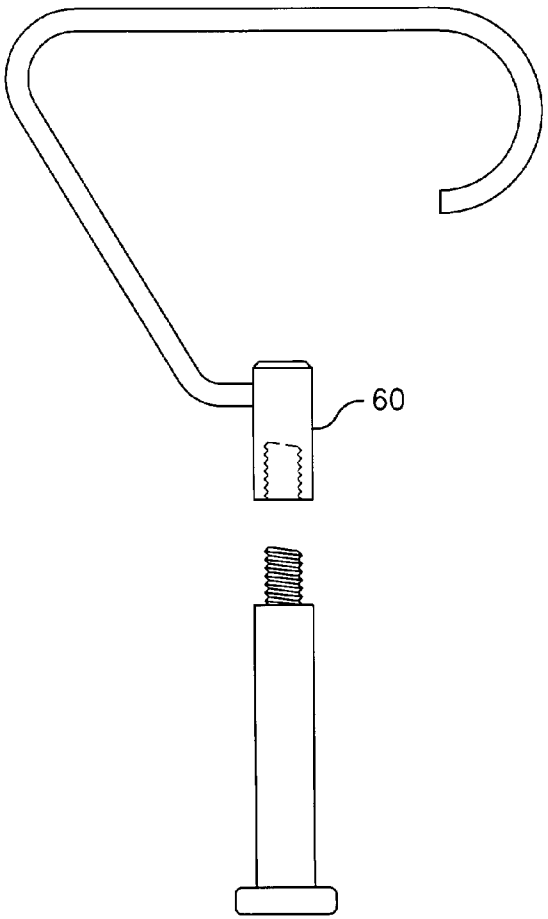
FIG. 11 is a front elevation view of a sixth alternative embodiment of the Hole Caddy.

While the handle 14 provides an inexpensive, multi-function means (handle, hanger, retainer) for securing hole saws to the stack pin, other types of handles may be used as well. For example, the handle could be provided as part of an element 60 that screws down onto the top of the stack pin 12, in which case the stack pin 12 would not need a keyhole slot (see FIG. 11). Further, the handle could be provided as part of a carabiner-like mechanism 62 (see FIG. 6), in which case the keyhole slot would only need to be a simple cylindrical through-bore 64. In this embodiment, the handle would have an end portion 66 that fits through the stack pin through-bore 64, and a lever arm 68, normally spring-biased in a closed position (as shown in FIG. 6), that would fit up against the handle end portion. To remove the handle, the lever arm would be pivoted back, and the handle end portion slid through the stack pin through-bore.

Figure 7:
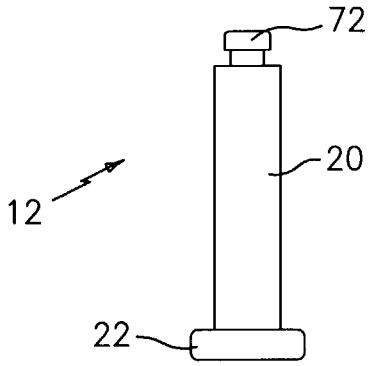
FIG. 7 is a front elevation view of a second alternative embodiment of the Hole Caddy.
Figure 8:
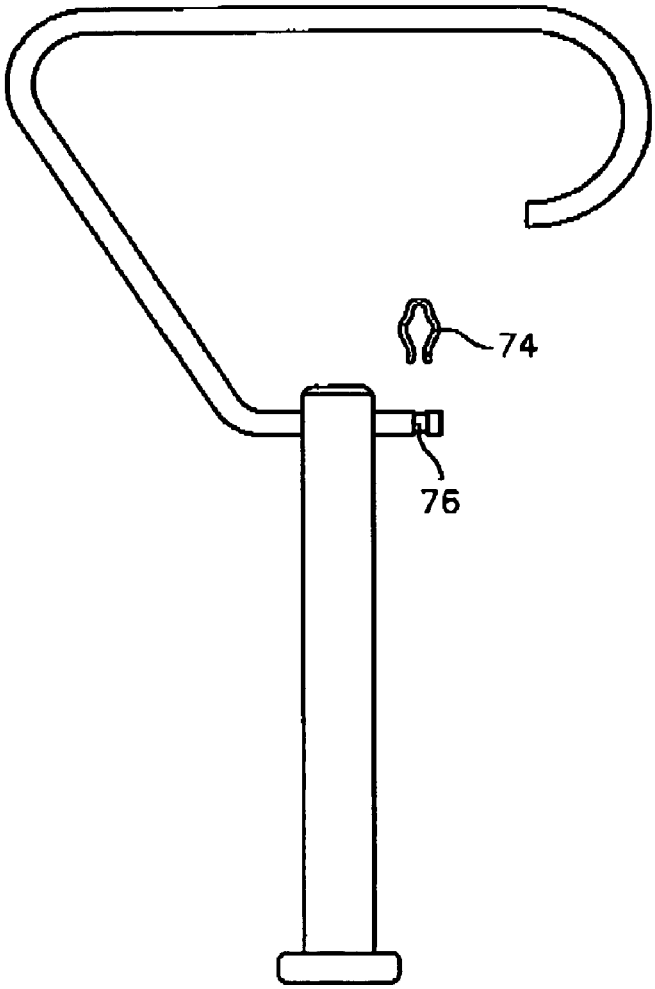
FIG. 8 is a front elevation view of a third alternative embodiment of the Hole Caddy.
Figure 10:
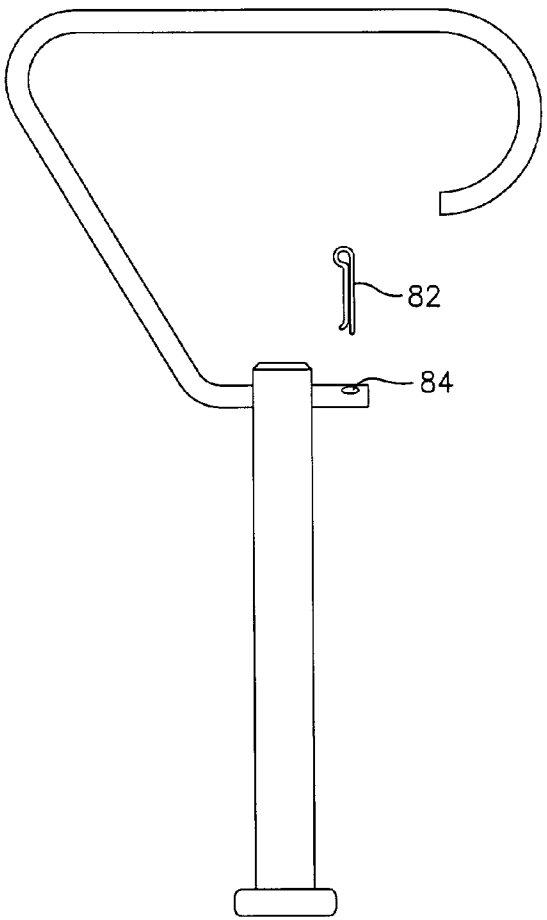
FIG. 10 is a front elevation view of a fifth alternative embodiment of the Hole Caddy.
Figure 9:
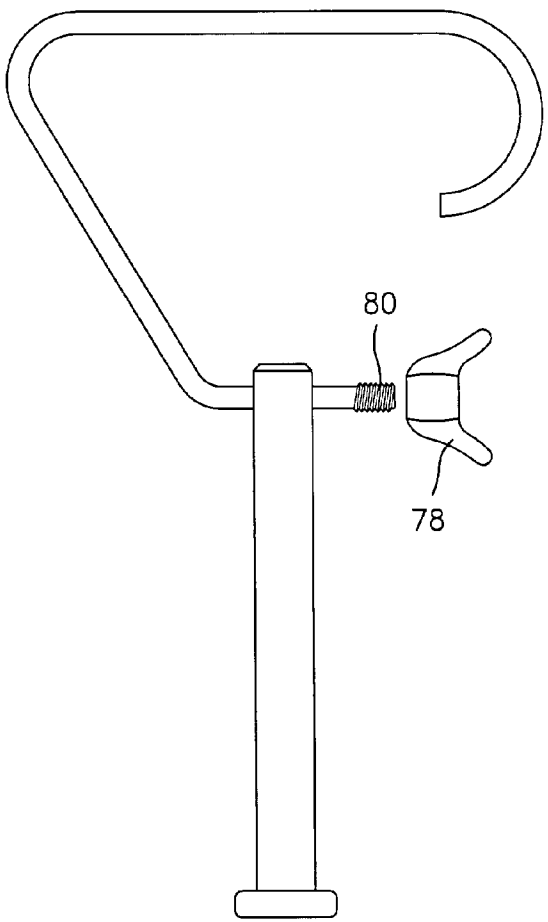
FIG. 9 is a front elevation view of a fourth alternative embodiment of the Hole Caddy.

The handle could also be attached to the stack pin 12 by way of a "quick release" mechanism (see FIG. 7), e.g., a retractable sleeve 70 and lipped protuberance 72 like those used for releasably connecting hoses to valve ends. Additionally, instead of having a keyhole slot and associated handle key, the stack pin could be provided with a standard through-bore 64, with the handle fitting through the through-bore and having some sort of removable closure member or mechanism. For example, FIG. 8 shows a retainer clip 74 and associated handle groove 76, FIG. 9 shows a wing nut 78 (or some other threaded removable fastener, such as a screw) and accompanying handle threading 80, and FIG. 10 shows a cotter pin 82 and associated handle pinhole 84. Of course, whatever mechanism was used, it would be necessary to ensure that: (i) the connection was strong enough to withstand the weight of numerous nested hole saws; and (ii) that there was little risk of the handle/retaining element coming detached from the stack pin accidentally.

Although there would be a slightly elevated risk of accidental release, it should be noted that the bun end 22 (support means) of the stack pin 12 could be removably attached to the shaft 20, by complementary threads, a fastener, or some type of quick release mechanism. Also, the bun 22 (support means) could be entirely replaced by a different type of removably-attached lower retainer element, such as a pin or carabiner, which would fit through a lateral through-bore located towards the "bottom" of the stack pin. This would allow someone to remove the hole saws from the bottom of a nested stack without having to remove all the hole saws from the stack pin 12.

The various versions of the handle described above and shown in the drawings may also be characterized as a "handle and retainer" means for selectively preventing hole saws stacked on the stack pin from being removed therefrom. Additionally, the bolt-like stack pin (i.e., the shaft and widened head or similar element, either detachable or not) may together be characterized as a "shaft support means" for holding a plurality of nested hole saws.

The various components of the Hole Caddy 10 can be made of metal, plastic, or any other suitably strong and durable material.

While the stack pin 12 has been described as having a generally cylindrical shaft 20, one of ordinary skill in the art will appreciate that the shaft could be any size or shape (e.g., hexagonal, square, irregular) that would accommodate stacked and/or nested hole saws.

Since certain changes may be made in the above device for storing and carrying hole saws, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Having thus described the invention, what is claimed is:

1. An assembly in combination with hole saws comprising:

a. a plurality of differently sized hole saws, wherein the hole saws have substantially circular back plates with diameters and central openings, wherein the diameters of the back plates are different from each other but the central openings are substantially the same size as each other; and b. carrying and storing means for carrying the hole saws removably stored coaxially on a stack pin, whereby the central openings fit over the stack pin and at least one of the hole saws can nest entirely within the confines of a larger one of the hole saws with the back plate of the nested hole saw touching the back plate of the larger hole saw, wherein the carrying and storing means comprises:

i. the stack pin having first and second ends, a widened head at the first end, and a keyhole-like slot extending through the stack pin proximate the second end, the stack pin being adapted in size and shape to hold at least one hole saw; and ii. a retaining handle removably and pivotally attached to the stack pin and having a key, portion wherein: the retaining handle can be detached from the stack pin only when the key is properly aligned with the keyhole-like slot; and the retaining handle is configured to prevent the at least one hole saw from being removed from the stack pin when the retaining handle is attached to the stack pin, and the handle can pivot within the slot, transversely to the stack pin, for ease of carrying.

2. The assembly of claim 1 wherein the stack pin has a shaft portion, and the widened head is removably attached to the shaft portion.

3. The assembly of claim 1 wherein: the key portion of the handle is oriented at about 45 degrees with respect to a plane defined by the remainder of the handle; and the keyhole-like slot is oriented at about 45 degrees with respect to a longitudinal axis of said stack pin.

4. The assembly of claim 1 wherein: the key portion of the handle is oriented at about 15 to 70 degrees with respect to a plane defined by the remainder of the handle; and the keyhole-like slot is oriented at about 15 to 70 degrees with respect to a longitudinal axis of said stack pin.

5. The assembly of claim 1 wherein: the stack pin has a shaft portion with a diameter of about 9/16 inches; and the widened head is attached to the shaft portion and has a diameter of about 3/4 inches.

6. The assembly of claim 1 wherein the handle further comprises a hanger, positioned at an end of the handle opposite the key, portion for hanging or storage.

7. An assembly in combination with hole saws comprising:

a. a plurality of differently sized hole saws, wherein the hole saws have substantially circular back plate with central openings, wherein the diameters of the back plates are different and the central openings are substantially the same size as one another; and b. carrying and storing means for carrying the hole saws removably stored coaxially on a stack pin, whereby the central openings fit over the stack pin and at least one of the hole saws can nest entirely within the confines of a larger one of the hole saws with the back plate of the nested hole saw touching the back plate of the larger hole saw, wherein the carrying and storing means comprises:

i. the stack pin includes a shaft having first and second ends and adapted in size and shape for the hole saws to be stacked on the shaft and a hole extending through the stack pin proximate the second end;

ii. support means having a lower retainer attached to the first end of the shaft, for supporting the plurality of hole saws stacked on the shaft; and c. handle and retainer means removably attached to the shaft proximate the second end for selectively preventing the hole saws stacked on the shaft from being removed from the shaft, wherein the handle and retaining means comprises:

i. and ii. a handle removably attached to the second end of the shaft and configured to prevent the hole saws stacked on the shaft from being removed from the shaft when the handle is attached to the shaft; and iii. wherein the handle has a cylindrical portion that extends transversely through the hole of the stack pin, whereby the handle can pivot within the hole and pivots transversely to the shaft, and wherein the cylindrical portion can be withdrawn selectively from the shaft to enable a hole saw to be removed.

8. The assembly for holding hole saws of claim 7 wherein the lower retainer is removably attached to the shaft by way of a key provided on the handle and a complementary keyhole-like slot extending through the shaft.

9. The assembly for holding hole saws of claim 8 wherein the lower retainer is permanently attached to the shaft.

10. The assembly for holding hole saws of claim 9 wherein the lower retainer is a widened head.

11. The assembly for holding hole saws of claim 10 wherein the widened head has a diameter of about 3/4 inches, and the shaft has a diameter of about 9/16 inches.

* * * * *